US007695274B2

(12) United States Patent
Caruso, II

(10) Patent No.: US 7,695,274 B2
(45) Date of Patent: Apr. 13, 2010

(54) LIGHTER WITH BUILT-IN CLIP

(76) Inventor: Augustine Caruso, II, 8800 Blvd. East, Apt. 1D, North Bergen, NJ (US) 07047

( * ) Notice: Subject to any disclaimer, the term of this patent is extended or adjusted under 35 U.S.C. 154(b) by 321 days.

(21) Appl. No.: 11/593,838

(22) Filed: Nov. 7, 2006

(65) Prior Publication Data

US 2008/0108004 A1 May 8, 2008

(51) Int. Cl.
*F23Q 2/32* (2006.01)
*F16B 45/02* (2006.01)

(52) U.S. Cl. ..... 431/253; 431/277

(58) Field of Classification Search ..... 431/253, 431/343, 277
See application file for complete search history.

(56) References Cited

U.S. PATENT DOCUMENTS

| | | | | | |
|---|---|---|---|---|---|
| 2,737,036 | A | | 3/1956 | Simpson | |
| 4,176,773 | A | * | 12/1979 | Wilkinson | 224/604 |
| 4,430,778 | A | * | 2/1984 | Sander | 24/598.3 |
| 4,745,661 | A | | 5/1988 | Wainscott | |
| 4,898,532 | A | | 2/1990 | Bercik | |
| 5,181,847 | A | | 1/1993 | Da Silva | |
| 5,271,730 | A | | 12/1993 | Acacio da Silva | |
| D373,442 | S | * | 9/1996 | Thomas | D27/141 |
| 5,740,905 | A | | 4/1998 | Kilfoy | |
| 6,196,382 | B1 | | 3/2001 | Lenderman | |
| D441,494 | S | | 5/2001 | Chen | |
| 6,430,782 | B1 | | 8/2002 | Torres et al. | |
| 6,820,612 | B2 | * | 11/2004 | Harabin | 128/200.23 |
| 2005/0246874 | A1 | * | 11/2005 | Hsu | 24/598.2 |

* cited by examiner

*Primary Examiner*—Steven B McAllister
*Assistant Examiner*—Nikhil Mashruwala
(74) *Attorney, Agent, or Firm*—Kenneth P. Glynn, Esq.; Deirdra M Meagher, Esq.

(57) ABSTRACT

A protrusion-free cigarette lighter with built-in clip for attachment of a chain or cord, to aid in avoiding loss, theft or misplacement of the lighter. The present invention lighter uniquely may stand on its own even though it has a chain clip, due to the fact that the clip is built into the main body of the lighter. The cigarette lighter includes: a.) a main housing having a top, a bottom and sidewalls, the bottom being predominantly flat so as to be standable upright on a horizontal surface, the main housing including lighter fuel storage means, conventional movement means for movement of lighter fuel to a flame area on the top, a flint striker located on the top for directing flint to the flame area and a control lever to permit and prevent fuel from flowing from the storage means to the flame area; and, b.) a clip mechanism located within a portion of the main housing and including a cut-out area to receive a chain or cord, a clip bar having a first position, being a closed position and having a second position, being an open position, the clip bar being moveably connected to the main body, a clip bar stop located on the main body, and a spring mechanism biasing the clips bar to its first position.

10 Claims, 7 Drawing Sheets

LIGHTER WITH BUILT-IN CLIP

BACKGROUND OF INVENTION a. Field of Invention

The invention relates generally to cigarette and cigar lighters that may be anchored by a cord, chain or other connector, so as to control use of the lights and to reduce or eliminate loss thereof. In addition, unlike other lighters with chain clips and hooks, the present invention lighters are constructed with the clip area inside the lighter housing so as to avoid protrusions in the pocket, reduce any injuries therefrom, and allow the lighters to be stood up, if desired.

b. Description of Related Art

The following patents are representative of lighters and attachments therefor, including direct and indirect connections:

U.S. Pat. No. D441,494 S to Chen describes a transparent cigarette lighter case.

U.S. Pat. No. 6,430,782 B1 to Torres et al. describes a lighter clip for use with a cigarette pack that is inexpensively manufactured from a material such as injection-molded plastic. A generally three-sided clip is sized and shaped to fit across the width and depth of the pack, and contains an arcuate portion, suitable for holding a lighter, on one end. The clip is manufactured from a resilient material, and shaped in a manner that causes it to be lightly biased against the pack, thereby holding the clip in position. The two longer clip arms are sized to have a large enough surface area to be suitable for promotional use, and the clip arms and ends are shaped to securely grip the cigarette pack.

U.S. Pat. No. 6,196,382 B1 to Lenderman describes a cigarette lighter holder made from a shell having a side wall and a bottom wall defining an upwardly opening chamber sized to slidably receive a cigarette lighter. A flexible rib within the chamber frictionally grasps the lighter to securely hold the lighter in the lighter holder. The rib can be formed on a sleeve in the chamber. A cord is mounted to the bottom of the shell, for example, by an eyelet secured to the shell bottom. The eyelet can be mounted to the shell bottom so that it can rotate relative to the shell. The cord is adapted to be secured to an article of clothing or a purse to help prevent loss of the holder and lighter if the user should accidentally drop the holder, with the lighter in it.

U.S. Pat. No. 5,740,905 to Kilfoy describes a key ring attachable lighter holding shell with flexible holding flaps which is a shell-shaped holder into which a reusable lighter or a disposable lighter may be inserted and held securely, yet can also be taken out and replaced again, and it may be attached to a key ring or key chain in order to help prevent a person from losing a lighter as long as the keys are not lost.

U.S. Pat. No. 5,271,730 to Acácio da Silva describes an improved lighter-key-holder arrangement, wherein the key-holder is independent from the lighter and comprises a detachable fitting having a cross-section similar to that of the lighter. The cross-section can be circular or rectangular. The fitting is coupled to the lighter by a threaded pin centrally formed thereon and received in a threaded bore hole centrally formed on the bottom surface of the lighter. The fitting is provided with a transverse opening that is closed by a latch actuated by a spring and manually operated by an external button. In another embodiment, the fitting has a cross-section different from that of the lighter. In yet another embodiment, the lighter body is spherical. In still another embodiment, a connecting ring may be provided on the body of the lighter, on the fitting or on the trigger lever of the lighter.

U.S. Pat. No. 5,181,847 to Da Silva describes an improved lighter-key-holder arrangement, wherein the key-holder is independent from the lighter and comprises a detachable fitting having a cross-section similar to that of the lighter. The cross-section can be circular or rectangular. The fitting is coupled to the lighter by a threaded pin centrally formed thereon and received in a threaded bore hole centrally formed on the bottom surface of the lighter. The fitting is provided with a transverse opening that is closed by a latch actuated by a spring and manually operated by an external button. In another embodiment, the fitting has a cross-section different from that of the lighter. In yet another embodiment, the lighter body is spherical.

U.S. Pat. No. 4,898,532 to Bercik describes a retractable lighter apparatus which discloses a retractable housing member including a spring-biased retractable first length of chain positionable within a housing secured to a second length of chain with an intermediate abutment sphere to maintain the second length of chain exteriorly of the housing. The second length of chain is integrally secured to a "C" shaped spring clip at its remote end securable about a cigarette lighter. The cigarette lighter and clip are positionable within a pouch of an internal diameter complementary to that of the external diameter of the "C" shaped clip, wherein the "C" shaped clip and associated second length of chain are directed within the pouch and along a slot axially positioned through a wall of the pouch. The retraction member and the pouch are each provided with clips for securement to various garment portions of an individual.

U.S. Pat. No. 4,745,661 to Wainscott describes a device which herein comprises a cord or chain, preferably an elastic cord, with means for fastening one end to a cigarette lighter and means such as a clip, at the other end for attaching the cord to a portion of a lady's purse or to an article of a man's clothing. This device facilitates the finding and retrieval of the cigarette lighter.

U.S. Pat. No. 4,082,496 to Johnson describes an attachment for cigarette lighters for ensuring against accidental loss or theft while at the same time providing convenient wearing and attractive display. Most cigarette lighters have been carried in independent fashion and are frequently lost or borrowed because of the absence of an attachment to a wearing garment. The present invention provides an attractive chain linkage for securing a cigarette lighter to wearing apparel, and particularly to a vest, which prevents loss of the lighter yet enables the wearer of the vest to have free use of the lighter. The chain is joined at one end to the non-flammable end of the lighter and especially the cap, which seals the inlet into the lighter casing for filling the lighter with ignitable fluid. Normally, the lighter with the attached end of the chain would be carried in a vest pocket. The balance of the chain is passed through a button hole of the vest and carries on its other end a weighted object, such as a watch, receivable in a pocket of the vest remote from the lighter. The chain is long enough to enable the wearer of the vest to take out the lighter without detaching the chain, light a cigarette held in his mouth.

U.S. Pat. No. 2,737,036 to C. Simpson describes an invention that relates to a combined wind guard and a detachable connecting means whereby a conventional cigarette lighter may be suspended from a flexible support, such as a chain or the like.

SUMMARY OF INVENTION

The present invention is a protrusion-free cigarette lighter with built-in clip for attachment of a chain or cord, to aid in avoiding loss, theft or misplacement of the lighter. The present invention lighter uniquely may stand on its own even though it has a chain clip, due to the fact that the clip is built into the main body of the lighter in a manner to achieve this objective. Elimination of protruding clip or chain elements eliminates bulkiness, possibilities of scratching or other minor injuries and makes it more easily storable.

The present invention cigarette lighter includes: a.) a main housing having a top, a bottom and sidewalls, the bottom being predominantly flat so as to be standable upright on a horizontal surface, the main housing including lighter fuel storage means, conventional movement means for movement of lighter fuel to a flame area on the top, a flint striker located on the top for directing flint to the flame area and a control lever to permit and prevent fuel from flowing from the storage means to the flame area; and, b.) a clip mechanism located within a portion of the main housing and including a cut-out area to receive a chain or cord, a clip bar having a first position, being a closed position and having a second position, being an open position, the clip bar being moveably connected to the main body, a clip bar stop located on the main body, and a spring mechanism biasing the clips bar to its first position.

In some preferred embodiments of the present invention cigarette lighter, the built-in clip has a clip mechanism that is located at the bottom of the main housing.

In some preferred embodiments of the present invention cigarette lighter, the clip bar is flat and parallel to the main housing bottom.

In some preferred embodiments of the present invention cigarette lighter, the lighter main housing is generally rectangular or square in shape and the clip mechanism is located at a bottom corner of the main housing.

In some preferred embodiments of the present invention cigarette lighter, the clip mechanism is located at a side of the main housing.

In some preferred embodiments of the present invention cigarette lighter, the main housing is made of a material selecting from the group consisting of metal, plastic and combination thereof. In some preferred embodiments of the present invention cigarette lighter, the clip mechanism is made of a material selected form the group consisting of metal, plastic and combination thereof.

In other preferred embodiments of the present invention, the cigarette lighter includes: a.) a main housing having a top, a bottom and sidewalls, the bottom being predominantly flat so as to be standable upright on a horizontal surface, the main housing including lighter fuel storage means, conventional movement means for movement of lighter fuel to a flame area on the top, a flint striker located on the top for directing flint to the flame area and a control lever to permit and prevent fuel from flowing from the storage means to the flame area; and, b.) a clip mechanism located within a portion of the main housing and including a cut-out area to receive a chain or cord, a clip bar having a first position, being a closed, rest position and having a second position, being an open position, the clip bar being a living spring that is moveably connected to the main body so as to be bendable from the first position to the second position and so as to return to the first position upon release. In this embodiment, the separate spring and hinge are eliminated. Many plastics may be used to create a living spring and the use of living spring technology is within the purview of the artisan. Among the possibilities, are polyethylene, polypropylene, blends of these, vinyl polmers, polyacrylonitriles, and others. Basically, the plastic clip bar will flex to open and recover to its original position when released.

The immediate aforesaid preferred embodiment may include any and all of the positional and other variations described supra in this summary.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
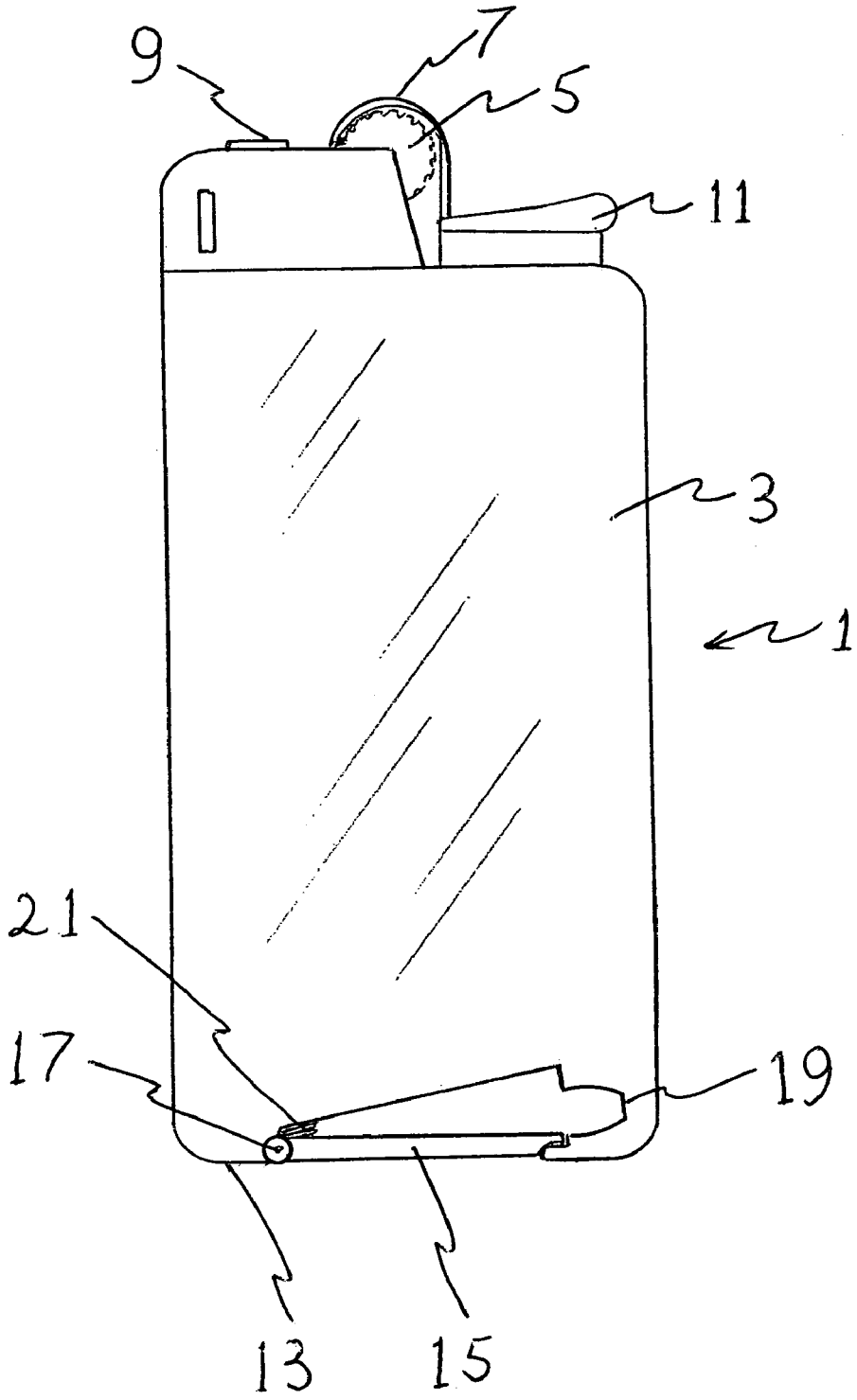
FIG. 1 is a front view of an embodiment of a cigarette lighter according to the present invention at rest, illustrating a bottom-based clip with a ring or loop clip slot.

Referring now to the drawings wherein like reference numerals designate corresponding parts throughout the several views wherein a particular embodiment is shown in more than one Figure, the present invention is shown in its functional structure and in its use.

FIG. 1 is a front view of an embodiment of a present invention cigarette lighter 1. Lighter 1 includes a main housing 3, made of metal, plastic, composite or other material, and it has conventional lighter components, such as flint wheel 5 for throwing a spark, gas valve lever 11 for holding the gas valve (hidden) open to hold a flame, sheath 7, and gas fuel outlet 9. As to the lighting functionality, it functions like any conventional lighter and is used in the same way by pushing down on the flint wheel 5 and holding the valve 11 down while lighting a cigar or cigarette (or as the user may otherwise intend) at the gas fuel outlet 9. Main housing 3 has a bottom 13 with a present invention clip mechanism built into it. The clip includes a clip open area 19 that is a cutout of the otherwise rectilinear shape of the main housing 3 and is of sufficient size and shape to accommodate a chain, such as a key ring or straight chain, or a cord, such as a strap, line, rope or string. In this embodiment, the cutout is askew with a notch for receiving the chain or cord, and many other cutout shapes could be alternatively employed.

There is also a clip bar 15 at bottom 13 that is rotatably connected at its left end, as shown, and is free to move at its right end so as to be moveable in an arc about hinge 17 upwardly toward the top of lighter 1. There is a spring 21, that is exposed for illustration purposes, but would normally be hidden, that biases clip bar 15 to the position shown in FIG. 1, i.e. its rest, closed position.

Figure 2:
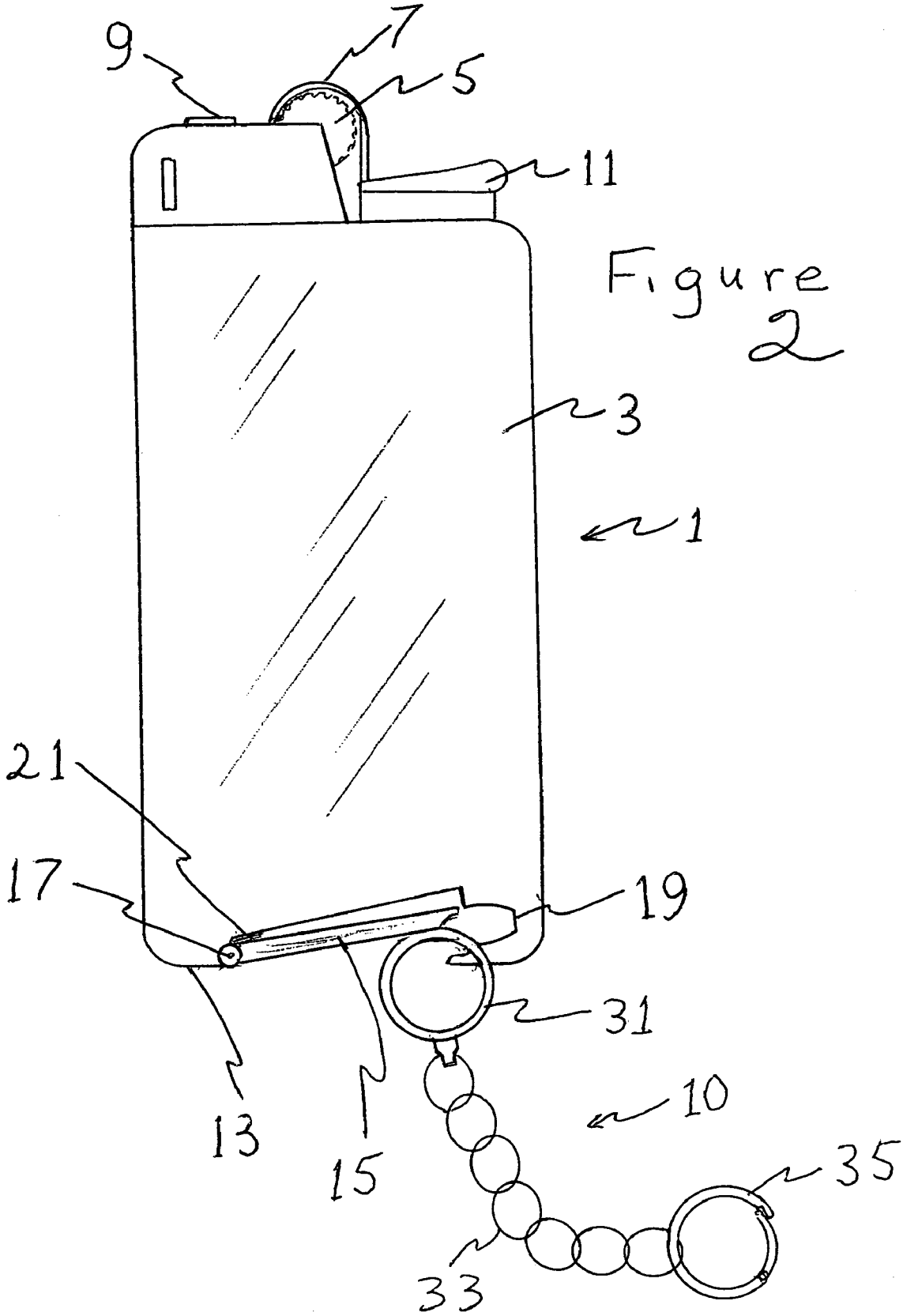
FIG. 2 is a front view of the embodiment of a cigarette lighter according to the present invention shown in FIG. 1, illustrating a bottom-based clip with a ring or loop clip slot, with a key ring being connected thereto.

FIG. 2 is a front view of the embodiment of the cigarette lighter 1 according to the present invention shown in FIG. 1, but illustrating the bottom-based clip bar 15 being pushed upwardly to its open position to receive the ring end 31 of key chain 10. This ring end 31 will slip into open area 19. (Key ring 10 has a central chain 33, a clip ring 35 for attachment to a belt loop, a pocket book strap or any other anchor, and the ring end 31.)

Figure 3:
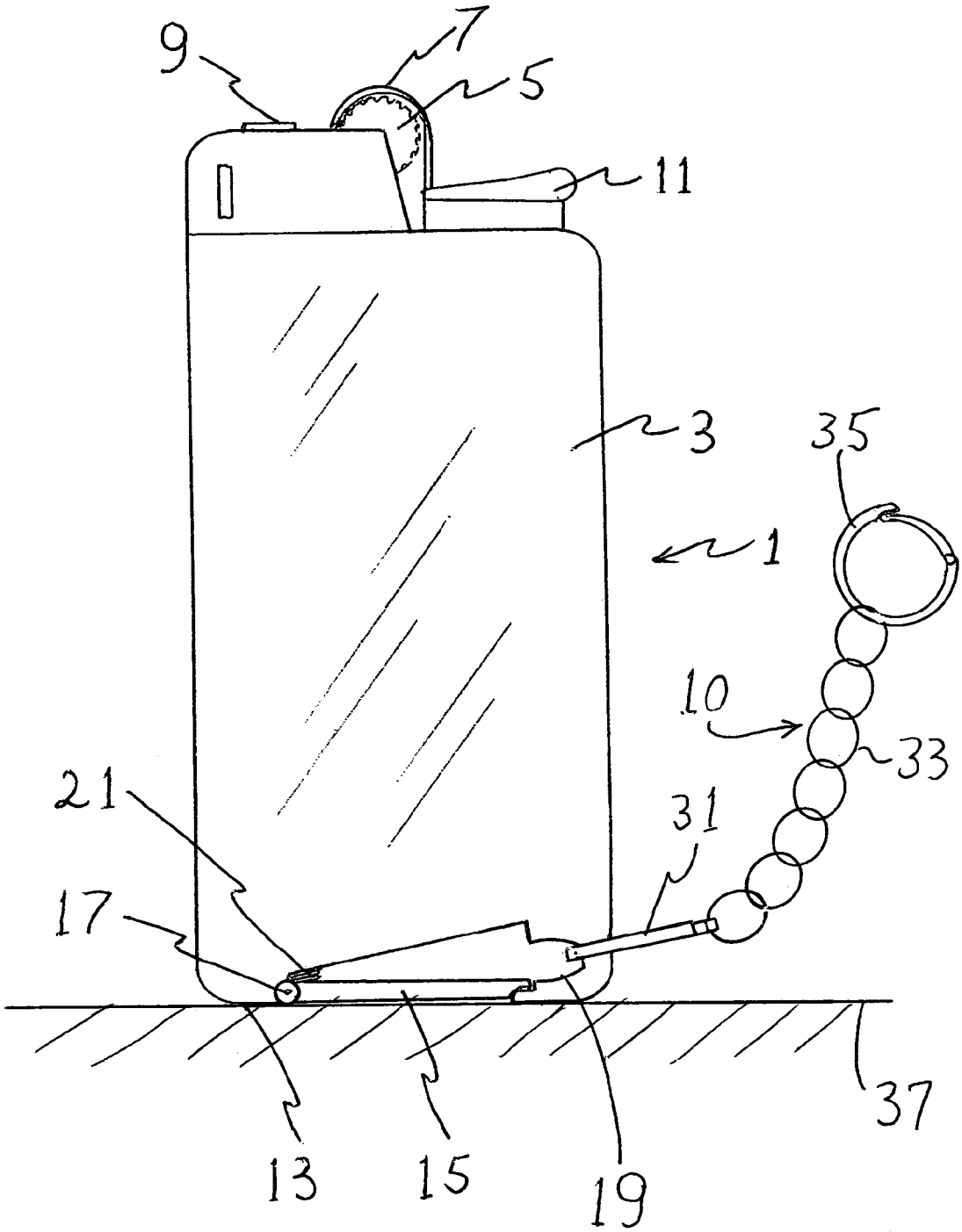
FIG. 3 is a front view of an embodiment of a cigarette lighter according to the present invention shown in FIGS. 1 and 2, with the key ring fully connected thereto and with the clip back to its rest, closed position.

FIG. 3 is a front view of an embodiment of the cigarette lighter 1 according to the present invention shown in FIGS. 1 and 2, with the key chain 10 fully connected thereto and with the clip bar 15 back to its rest, closed position to secure the key chain 10 thereto.

Figure 4:
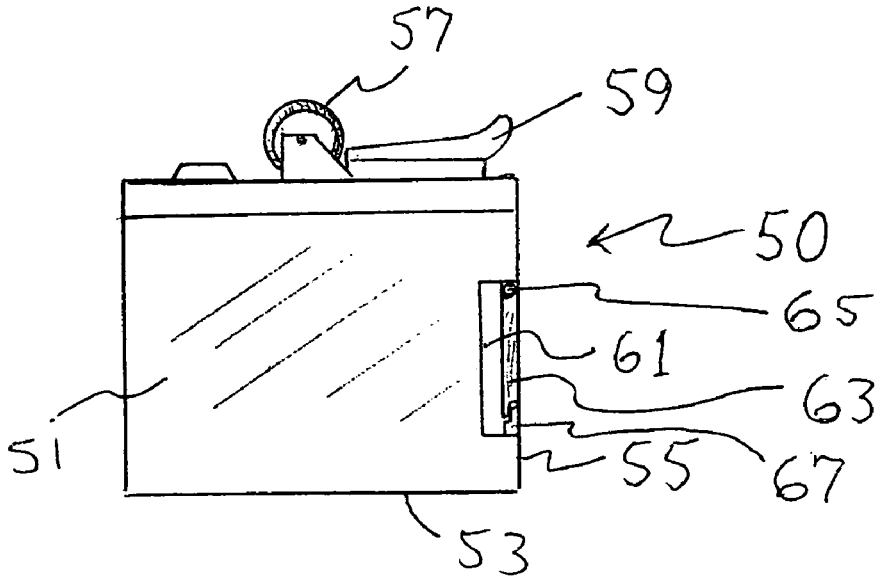
FIG. 4 is a front view of another embodiment of a cigarette lighter according to the present invention with a side-based clip.

FIG. 4 is a front view of another embodiment of a cigarette lighter 50 according to the present invention with a side-based clip mechanism. Lighter 50 includes a main housing 51, made of metal, plastic, composite or other material, and it has conventional lighter components, such as flint wheel 57 for throwing a spark, a gas valve lever 59 and gas fuel outlet. Main housing 51 has a bottom 53 and a side 55 with a present invention clip mechanism built into side 55. The clip includes a rectangular open area 61 that is a cutout of the otherwise rectilinear shape of the main housing 51 and is of sufficient size and shape to accommodate a chain or a cord. There is also a clip bar 63 at side 55 with a stop 67, as shown. Clip bar 63 is rotatably connected at its top end, as shown, and is free to move at its bottom end so as to be moveable in an arc about hinge 65 inwardly toward the center of lighter 50. There is a spring (not shown), that biases clip bar 63 to the position shown in FIG. 4, i.e. its rest, closed position. It functions in a general fashion similar to the present invention lighter 1 illustrated in FIGS. 1 through 3 above.

Figure 5:
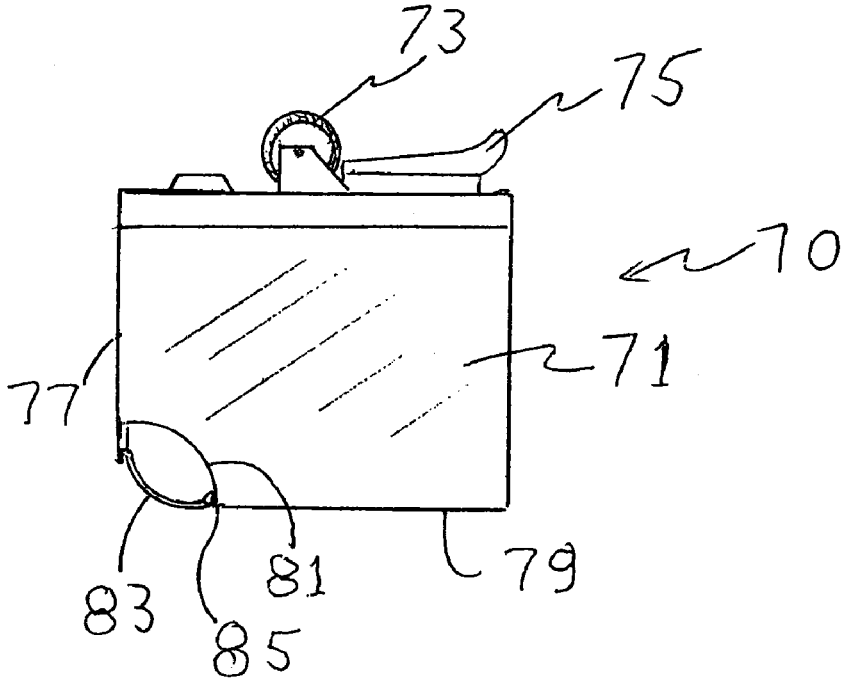
FIG. 5 is a front view of another embodiment of a cigarette lighter according to the present invention with a corner-based clip.

FIG. 5 is a front view of another embodiment of a cigarette lighter according to the present invention with a corner-based clip mechanism. Lighter 70 includes a main housing 71, and it has conventional lighter components, such as flint wheel 37, a gas valve lever 75 and gas fuel outlet. Main housing 71 has a bottom 79 and a left side 77 with a present invention clip mechanism built into the left corner, as shown. The clip includes a quarter circle open area 81 that is a cutout of the otherwise rectilinear shape of the main housing 71 and is of sufficient size and shape to accommodate an anchoring line, such as a chain or a cord. There is also an arcuate clip bar 83 with a stop, as shown. Clip bar 83 is rotatably connected at its bottom end, as shown, and is free to move at its top end so as to be moveable in an arc about hinge 85 inwardly toward the center of lighter 70. There is a spring (not shown), that biases clip bar 83 to the position shown in FIG. 5, i.e. its rest, closed position. It functions in a general fashion similar to the present invention lighter 1 illustrated in FIGS. 1 through 3 above.

Figure 6:
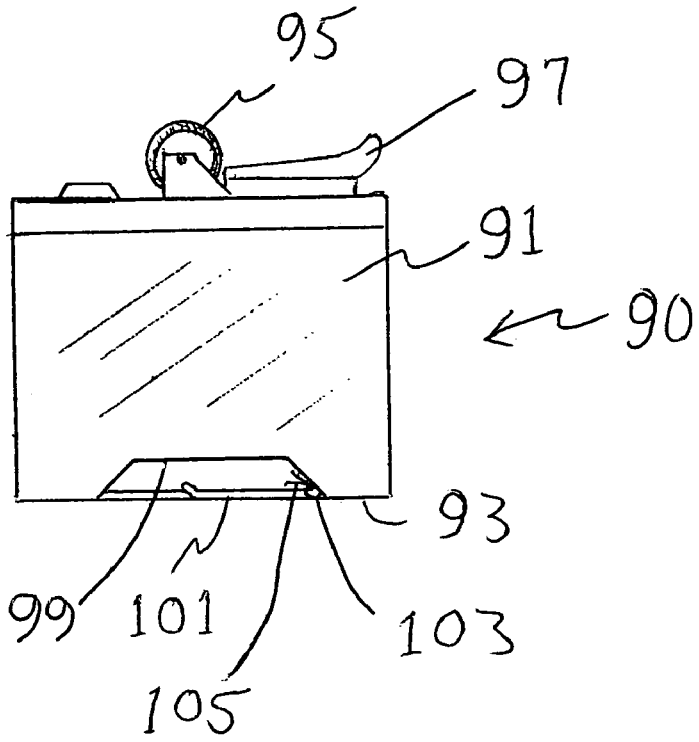
FIG. 6 is a front view of another embodiment of a cigarette lighter according to the present invention with a bottom-based clip.

FIG. 6 is a front view of another embodiment of a cigarette lighter according to the present invention with a bottom-based trapezoidal clip mechanism. Lighter 90 includes a main housing 91, and it has conventional lighter components, such as flint wheel 97, a gas valve lever 97 and gas fuel outlet. Main housing 91 has a bottom 93 with a present invention trapezoidal shaped clip mechanism built into it. The clip mechanism includes a trapezoidal open area 99 that is a cutout of the otherwise rectilinear shape of the main housing 91 and is of sufficient size and shape to accommodate a chain or a cord. There is also a clip bar 101 with a stop, as shown. Clip bar 101 is rotatably connected and is free to move so as to be moveable in an arc about hinge 103 upwardly toward the top of lighter 90. There is a spring 105, that biases clip bar 101 to the position shown in FIG. 6, i.e. its rest, closed position. It functions in a general fashion similar to the present invention lighter 1 illustrated in FIGS. 1 through 3 above.

Figure 7:
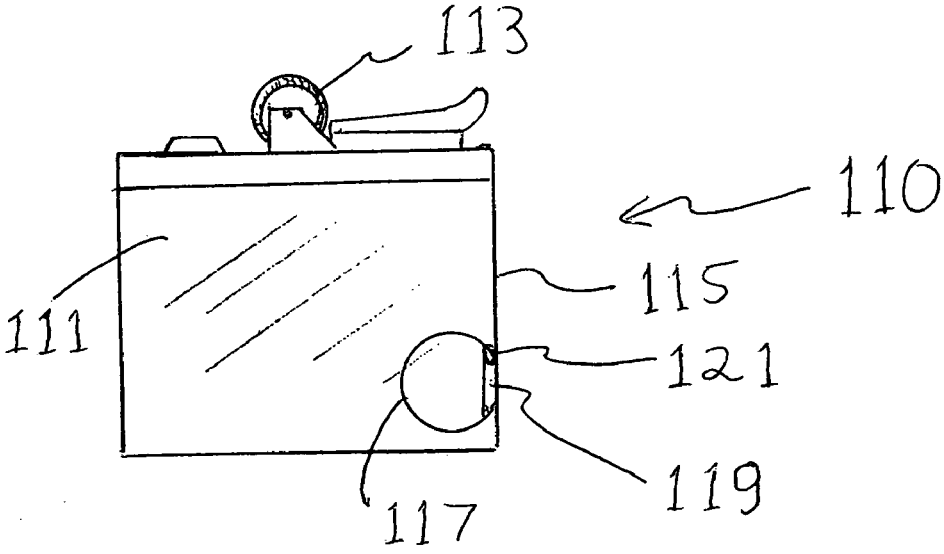
FIG. 7 is a front view of another embodiment of a cigarette lighter according to the present invention with a circular opening, side-based clip.

FIG. 7 is a front view of another embodiment of a cigarette lighter according to the present invention with a circular opening, side-based clip mechanism. Lighter 110 includes a main housing 111, and it has conventional lighter components, such as flint wheel 113 for throwing a spark. Main housing 111 has a side 115 with a present invention clip mechanism built into side 115. The clip includes a circular open area 117 that is a cutout of the otherwise rectilinear shape of the main housing 111 and is of sufficient size and shape to accommodate a chain or a cord. There is also a clip bar 119 with a stop, as shown. Clip bar 119 is rotatably connected at its top end, as shown, and is free to move at its bottom end so as to be moveable in an arc about hinge 121 inwardly toward the center of lighter 50. There is a spring (not shown), that biases clip bar 119 to the position shown in FIG. 7, i.e. its rest, closed position. It functions in a general fashion similar to the present invention lighter 1 illustrated in FIGS. 1 through 3 above.

Figure 8:
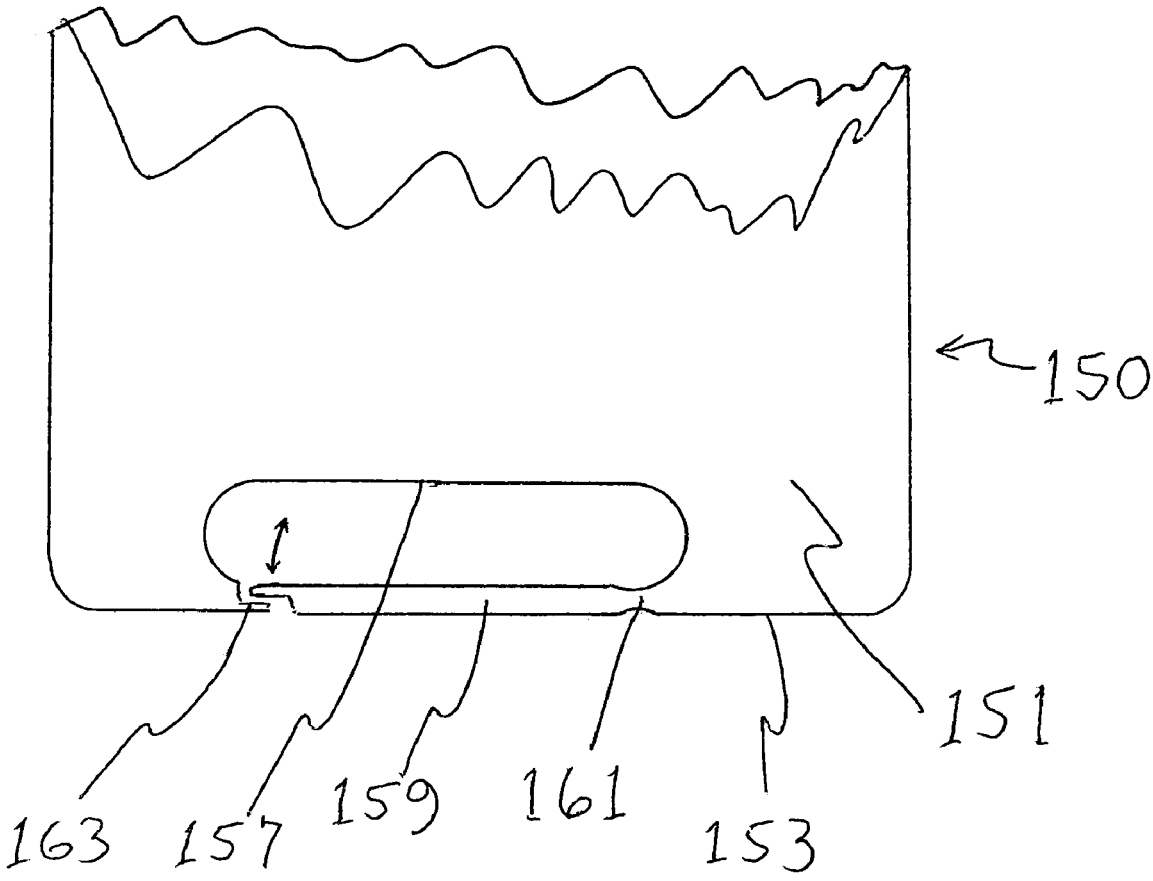
FIG. 8 is an enlarged front sectional view of another embodiment of a cigarette lighter according to the present invention with a bottom-based clip having a living hinge clip bar that is unistructurally molded as part of the main housing; and, FIG. 9 is a front view of another embodiment of a cigarette lighter according to the present invention with a bottom-based semicircular opening type clip.

FIG. 8 is an enlarged front sectional view of another embodiment of a cigarette lighter 150 according to the present invention with a bottom-based clip mechanism, having a living hinge 161 formed in clip bar 159 at bottom 153 that is unistructurally molded as part of the main housing. There is a stop 163 and an oval open area 157. The living hinge 161 replaces both a separate spring and a hinge. It used in the same fashion as lighter 1 discussed above (FIGS. 1,2 and 3).

Figure 9:
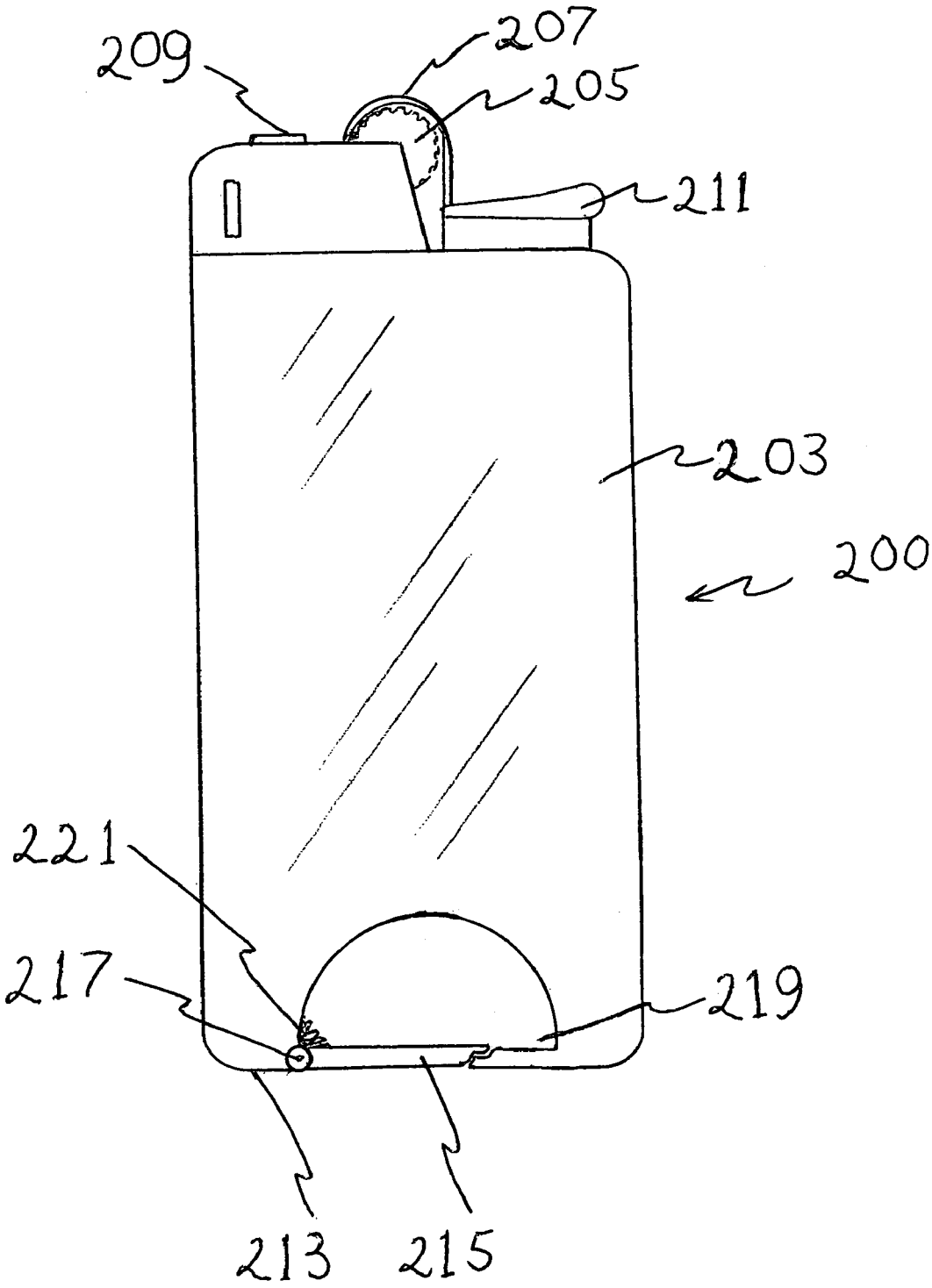

FIG. 9 is a front view of another embodiment of a cigarette lighter according to the present invention with a bottom-based semicircular opening type clip mechanism. Lighter 200 includes a main housing 203, made of metal, plastic, composite or other material, and it has conventional lighter components, such as flint wheel 205 for throwing a spark, a gas valve lever 211 and gas fuel outlet 209. Main housing 203 has a bottom 213 with a present invention clip mechanism built into it. The clip includes a circular open area 219 that is a cutout of the otherwise rectilinear shape of the main housing 203 and is of sufficient size and shape to accommodate a chain or a cord. There is also a clip bar 215 at bottom 213 with a stop, as shown. Clip bar 215 is rotatably connected at one end, as shown, and is free to move at its other end so as to be moveable in an arc about hinge 217 inwardly toward the center of lighter 200. There is a spring 221, that biases clip bar 215 to the position shown in FIG. 9, i.e. its rest, closed position. It functions in a general fashion similar to the present invention lighter 1 illustrated in FIGS. 1 through 3 above.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A cigarette lighter with built-in clip for attachment of a chain or cord, which comprises:

a.) a unitary main housing having a top, a bottom and sidewalls, said bottom being predominantly flat so as to be standable upright on a horizontal surface, said main housing including lighter fuel storage means, conventional movement means for movement of lighter fuel to a flame area on said top, a flint striker located on said top for directing flint to said flame area and a control lever to permit and prevent fuel from flowing from said storage means to said flame area; and, b.) a clip mechanism formed within a portion of said main housing and including a cut-out area to receive a chain or cord, a clip bar having a first position, being a closed position wherein a first face of said clip bar is substantially flush with said bottom of said main housing and having a second position, being an open position, said clip bar being rotatably connected to said main body so as to be moveable in an arc, a clip bar stop located on said main body, and a spring mechanism biasing said clip bar to its first position wherein said spring mechanism contacts said main body and a second face of said clip bar opposite said first face.

2. The cigarette lighter with built-in clip for attachment of a chain or cord, of claim 1 wherein said clip mechanism is located at said bottom of said main housing.

3. The cigarette lighter with built-in clip for attachment of a chain or cord, of claim 2 wherein said clip bar is flat and parallel to said main housing bottom.

4. The cigarette lighter with built-in clip for attachment of a chain or cord, of claim 1 wherein said main housing is made of a material selecting from the group consisting of metal, plastic and combination thereof.

5. The cigarette lighter with built-in clip for attachment of a chain or cord, of claim 4 wherein said clip mechanism is made of a material selected form the group consisting of metal, plastic and combination thereof.

6. A cigarette lighter with built-in clip for attachment of a chain or cord, which comprises:

a.) a unitary main housing having a top, a bottom and sidewalls, said bottom being predominantly flat so as to be standable upright on a horizontal surface, said main housing including lighter fuel storage means, conventional movement means for movement of lighter fuel to a flame area on said top, a flint striker located on said top for directing flint to said flame area and a control lever to permit and prevent fuel from flowing from said storage means to said flame area; and, b.) a clip mechanism formed within a portion of said main housing and including a cut-out area formed in an arc shape to receive a chain or cord, a clip bar having a first position, being a closed position wherein a first face of said clip bar is substantially flush with said bottom of said main housing and having a second position, being an open position, said clip bar being rotatably connected to said main body so as to be moveable in an arc, a clip bar stop located on said main body, and a spring mechanism biasing said clip bar to its first position wherein said spring mechanism contacts said main body and a second face of said clip bar opposite said first face.

7. The cigarette lighter with built-in clip for attachment of a chain or cord, of claim 6 wherein said clip bar is flat and parallel to said main housing bottom.

8. The cigarette lighter with built-in clip for attachment of a chain or cord, of claim 6 wherein said main housing is made of a material selecting from the group consisting of metal, plastic and combination thereof.

9. The cigarette lighter with built-in clip for attachment of a chain or cord, of claim 6 wherein said clip mechanism is made of a material selected form the group consisting of metal, plastic and combination thereof.

10. The cigarette lighter with built-in clip for attachment of a chain or cord, of claim 6 wherein said main housing is made of plastic.

* * * * *